US009284894B2

(12) United States Patent
Orban et al.

(10) Patent No.: US 9,284,894 B2
(45) Date of Patent: Mar. 15, 2016

(54) REDUCED TORQUE VARIATION FOR ENGINES WITH ACTIVE FUEL MANAGEMENT

(71) Applicant: GM GLOBAL TECHNOLOGY OPERATIONS LLC, Detroit, MI (US)

(72) Inventors: Hatem Zakaria Orban, Auburn Hills, MI (US); Craig D. Marriott, Clawson, MI (US); Robert S. McAlpine, Lake Orion, MI (US); Dustin Loveland, Holly, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 333 days.

(21) Appl. No.: 13/912,700

(22) Filed: Jun. 7, 2013

(65) Prior Publication Data

US 2014/0360459 A1 Dec. 11, 2014

(51) Int. Cl.
*F02D 17/02* (2006.01)
*F02B 75/06* (2006.01)

(52) U.S. Cl.
CPC ..... *F02D 17/026* (2013.01); *F02B 75/06* (2013.01)

(58) Field of Classification Search
CPC ..... F02D 17/026; F02D 17/02; F02D 17/00; F02B 75/06
See application file for complete search history.

(56) References Cited

U.S. PATENT DOCUMENTS

| | | | | |
|---|---|---|---|---|
| 6,216,667 | B1 * | 4/2001 | Pekar | 123/320 |
| 2005/0131618 | A1 * | 6/2005 | Megli et al. | 701/101 |
| 2008/0011253 | A1 * | 1/2008 | Nakamura | 123/90.15 |

* cited by examiner

*Primary Examiner* — Lindsay Low
*Assistant Examiner* — Jacob Amick
(74) *Attorney, Agent, or Firm* — Cantor Colburn LLP

(57) ABSTRACT

In one exemplary embodiment, a method for active fuel management in an engine having a plurality of cylinders is provided, the method including stopping a fuel flow into a first set of the plurality of cylinders, the stopping causing a deactivation of the first set of cylinders and continuing injection of fuel into a second set of the plurality of cylinders to provide power while the first set of cylinders are deactivated. The method also includes injecting gas into the first set of the plurality of cylinders when each of the first set of cylinders are at bottom dead center, the injected gas increasing a cylinder pressure in each of the first set of cylinders that reduces an amplitude of first order torque variations during operation of the engine while the first set of cylinders are deactivated.

20 Claims, 4 Drawing Sheets

REDUCED TORQUE VARIATION FOR ENGINES WITH ACTIVE FUEL MANAGEMENT

FIELD OF THE INVENTION

The subject invention relates to engines with active fuel management and more particularly reducing low order torque in engines using cylinder deactivation.

BACKGROUND

In an effort to reduce fuel consumption, engines may employ active fuel management when the engines experience lower load conditions. In a case of a multiple-cylinder engine (e.g., inline four), a portion of the cylinders are "deactivated," where fuel is not injected to the deactivated cylinders at low loads). During cylinder deactivation, both intake and exhaust valves remain closed using a valve deactivation mechanism. In some cases, the operating range for active fuel management ("AFM") using cylinder deactivation is limited by vibration and torque variations that can occur while the deactivated cylinders are motoring (i.e., not firing). Thus, a reduced operating range (e.g., limited to very low engine loads) for AFM can reduce fuel economy for an engine that may otherwise benefit from cylinder deactivation.

SUMMARY OF THE INVENTION

In one exemplary embodiment of the invention, a method for active fuel management in an engine having a plurality of cylinders is provided, the method including stopping a fuel flow into a first set of the plurality of cylinders, the stopping causing a deactivation of the first set of the plurality of cylinders and continuing injection of fuel into a second set of the plurality of cylinders to provide power while the first set of the plurality of cylinders are deactivated. The method also includes injecting gas into the first set of the plurality of cylinders when each of the first set of the plurality of cylinders are at bottom dead center, the injected gas increasing a cylinder pressure in each of the first set of the plurality of cylinders that reduces an amplitude of first order torque variations during operation of the engine while the first set of the plurality of cylinders are deactivated.

In another exemplary embodiment of the invention, an internal combustion engine includes a first set of cylinders, a second set of cylinders, a fuel supply line and an air supply line for each cylinder of the first and second sets of cylinders, a supplemental gas supply line for each cylinder of the second set of cylinders and a controller communicably coupled to the supplemental gas supply line, wherein the controller is configured to perform a method. The method includes stopping a fuel flow into the first set of cylinders, the stopping causing a deactivation of the first set of cylinders, continuing injection of fuel into the second set of cylinders to provide power while the first set of cylinders are deactivated and injecting gas, via the supplemental gas supply lines, into the first set of cylinders when each of the first set of cylinders are at bottom dead center, the injected gas increasing a cylinder pressure in each of the first set of the plurality of cylinders that reduces an amplitude of first order torque variations during operation of the engine while the first set of the plurality of cylinders are deactivated.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
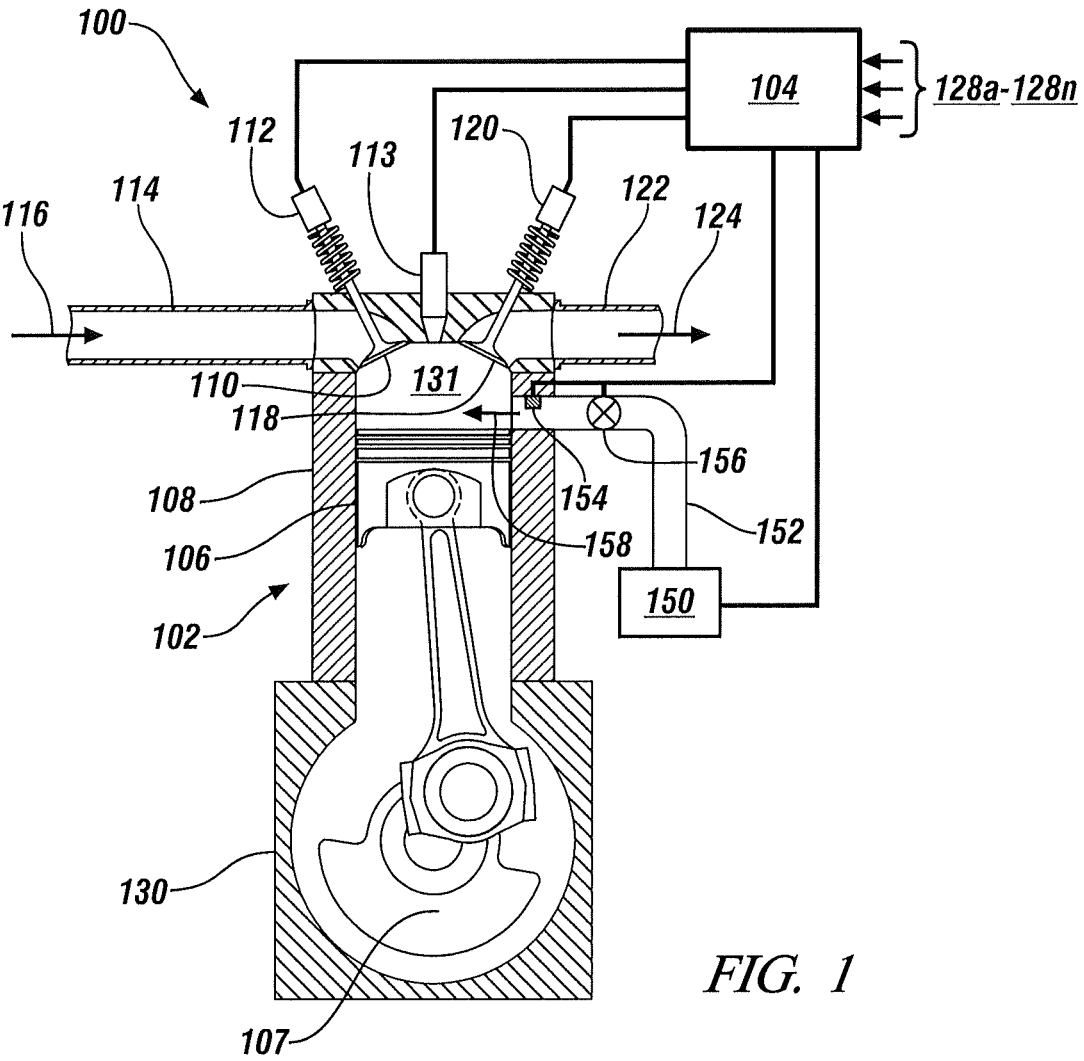
FIG. 1 is a schematic diagram of an engine system according an embodiment.

The following description is merely exemplary in nature and is not intended to limit the present disclosure, its application or uses. It should be understood that throughout the drawings, corresponding reference numerals indicate like or corresponding parts and features. As used herein, the terms controller and module refer to an application specific integrated circuit (ASIC), an electronic circuit, a processor (shared, dedicated, or group) and memory that executes one or more software or firmware programs, a combinational logic circuit, and/or other suitable components that provide the described functionality. In embodiments, a controller or module may include one or more sub-controllers or sub-modules.

In accordance with an exemplary embodiment of the invention, FIG. 1 is a schematic diagram of a portion of an internal combustion (IC) engine system 100. The IC engine system 100 includes an internal combustion (IC) engine 102 and a controller 104. In an embodiment, the IC engine 102 is a diesel engine. In another embodiment, the IC engine 102 is a spark-ignition engine. In embodiments, the IC engine 102 is a four-stroke engine. The IC engine 102 includes a piston 106 disposed in a cylinder 108. For ease of understanding, a single cylinder 108 is depicted, however, it should be understood that the IC engine 102 may include a plurality of pistons 106 disposed in a plurality of cylinders 108, wherein each of the cylinders 108 receive a combination of combustion air and fuel via the depicted arrangement. The IC engine 102 may have a plurality of cylinders 108, such as 2, 3, 4, 5, 6, 7, 8 or more cylinders, arranged in a suitable fashion, such as an inline, "V" or boxer configuration. In embodiments, the depicted engine system and method applies to an inline four cylinder engine that deactivates one, two or three cylinders during a fuel saving mode. In another embodiment, the depicted engine system and method applies to a six cylinder engine (inline, V or boxer configuration) that deactivates two or four cylinders during the fuel saving mode. It should be understood that the depicted system and method applies to various engine configurations that use cylinder deactivation for fuel saving.

During operation of the IC engine 102, combustion air/fuel mixture is combusted resulting in reciprocation of the pistons 106 in the cylinders 108. The reciprocation of the pistons 106 rotates a crankshaft 107 located within a crankcase 130 to deliver motive power to a vehicle powertrain (not shown) or to a generator or other stationary recipient of such power (not shown) in the case of a stationary application of the IC engine 102.

The air/fuel mixture is formed from an air flow 116 received via an air intake 114 and a fuel supply 113, such as a fuel injector. A valve 110 is disposed in the air intake 114 to control fluid flow and fluid communication of air between the air intake 114 and the cylinder 108. In exemplary embodiments, position of the valve 110 and the corresponding air flow 116 are controlled by an actuator 112 in signal communication with and controlled by the controller 104. After combustion of the air/fuel mixture, an exhaust gas 124 flows from the cylinder via exhaust passage 122. An exhaust valve 118 is coupled to an actuator 120 to control fluid flow and communication between the cylinder 108 and the exhaust passage 122. In an embodiment, the controller 104 communicates with the actuator 120 to control movement of the actuator 120. The controller 104 collects information regarding the operation of the IC engine 102 from sensors **128*a*-128*n*, such as temperature (intake system, exhaust system, engine coolant, ambient, etc.), pressure, and exhaust flow rates, and uses the information to monitor and adjust engine operation. In addition, the controller 104 controls fluid flow from the fuel injector 113 into the cylinder 108. The controller 104 is also in signal communication with a sensor 126**, which may be configured to monitor a variety of cylinder parameters, such as pressure or temperature.

A supplemental air supply 150 provides air or another suitable gas to the cylinders 108 via supplemental lines 152. A valve 156 controls flow of air from the supplemental air supply 150 to the cylinders 108. In an embodiment, a position of the valve 156 is controlled by the controller 104, thus controlling a supplemental air flow 158. A sensor 154 is in communication with the controller 104 and provides a signal corresponding to the cylinder pressure to the controller 104, where the cylinder pressure is used to control torsional fluctuations and vibration in the engine. It should be understood that, for IC engine systems 100 with a plurality of cylinders 108, each of the plurality of cylinders that may be deactivated during reduced fuel operation may have corresponding supplemental lines 152, valves 156, supplemental air supplies 150 and sensors 154.

In an embodiment, the IC engine system 100 conserves fuel consumption by deactivating a first set of cylinders 108 while continuing combustion of the air-fuel mixture in a second set of cylinders 108. The deactivated cylinders do not receive fuel from the fuel injector 113 during active fuel management. When operating in the reduced fuel consumption mode, the deactivated cylinders may cause a significant vibration in the IC engine system 100 due to a first order torque variation. Accordingly, embodiments of the engine system inject the supplemental air flow 158 to increase a pressure in the deactivated cylinder 108, where the increased cylinder pressure reduces the amplitude of the first order torque variations. Thus, the supplemental air supply 150 and supplemental line 152 provide supplemental air flow 158 to the cylinder 108 while fuel supply and air supply are shut off from fuel injector 113 and the air intake 114, respectively. As discussed herein, air may include a combination of other gases and air. Further, as discussed herein, gas may be injected into the deactivated cylinder, where gas may include air or any gas or gaseous compound to increase compression pressure in the cylinders, such as air, exhaust, inert gas or combinations thereof. In embodiments, active fuel management is provides for the IC engine system 100 while also reducing engine vibration by reducing first order torque variation when a first set of cylinders are deactivated. In an embodiment, the reduced vibration reduces vehicle wear and tear while improving the driver experience.

Figure 2:
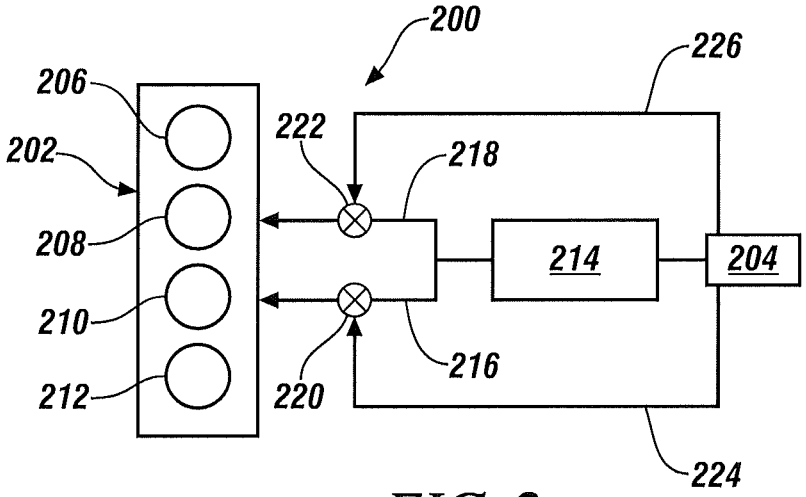
FIG. 2 is a schematic diagram of an engine system according another embodiment.

FIG. 2 is a schematic diagram of part of an engine system 200 according to an embodiment. The engine system 200 includes an engine 202 and a controller 204. The engine 202 includes cylinders 206, 208, 210 and 212. The engine system also includes a supplemental air supply 214 that directs air through lines 216 and 218 to cylinders 208 and 210, respectively, when the engine system 200 enables a fuel saving mode. In embodiments, the fuel saving mode uses an active fuel management process that deactivates cylinders 208 and 210 while combustion continues in cylinders 206 and 212. Flow control devices, such as valves 220 and 220, are configured to control air flow and pressure within cylinders 210 and 208, respectively. As discussed above, the supplemental air supply 214 may inject air into the cylinders 208 and 210 when the cylinders are at bottom dead center (BDC) to increase an overall cylinder pressure in the deactivated cylinders. The increased pressure in cylinders 208 and 210 reduces the amplitude of a first order torque variation experienced by the engine system 200 and, thus, reduces vibration and resulting wear and tear. Further, reduced vibration improves the driver experience during vehicle operation while in the fuel saving mode.

In an embodiment, during the fuel saving mode, the increased pressure is provided to the deactivated cylinders receive injected air from the supplement air supply while air flow valves and fuel flow valves, used during combustion, remain closed. The supplement air lines may be located in any suitable position to inject air into the cylinders, such as proximate or in the engine head. In embodiments, the controller controls the deactivated cylinder pressure based on various engine operation parameters, such as engine load and engine speed. In an embodiment the controller controls the cylinder pressure based on a pressure at bottom dead center in supplemental air supply lines fluidly connected to the first set of the plurality of cylinders. Further, the controller controls air injected into the deactivated cylinders based on an amount of air that leaks by piston rings in the deactivated cylinders to compensate for leaked air. In embodiments, the increased pressured within the deactivated cylinders resists movement of the pistons within the deactivated cylinders to reduce the amplitude of first order torque variations during the fuel saving mode.

Figure 3:
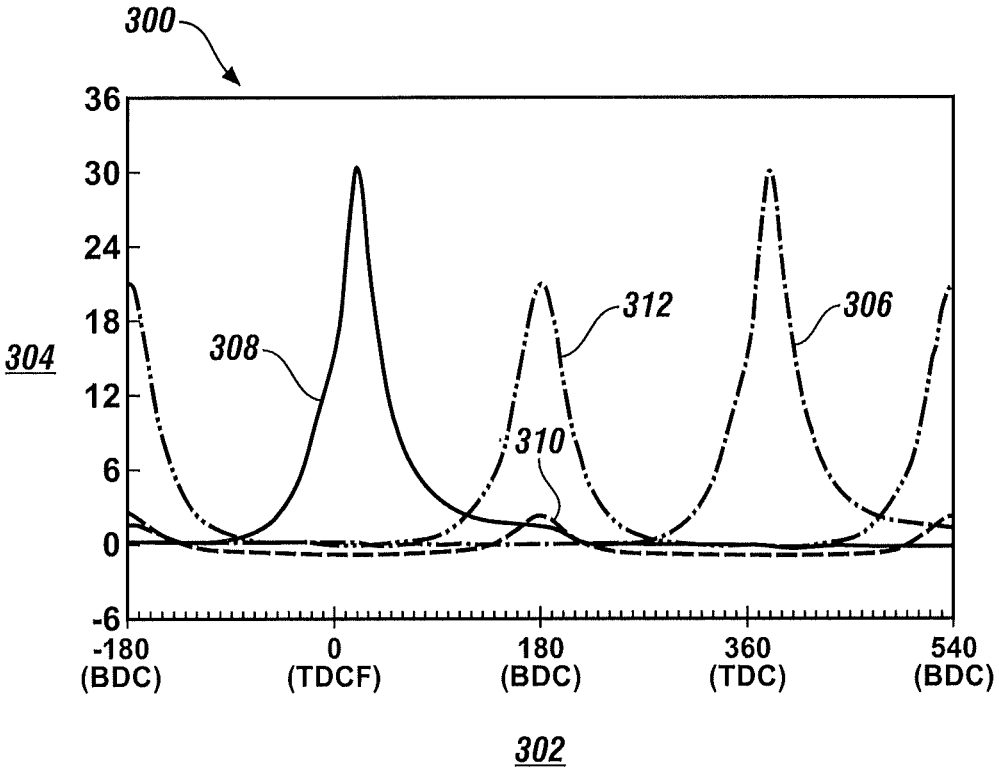
FIG. 3 is a graph of an engine system utilizing active fuel management and increased deactivated cylinder pressure to reduce amplitude of first order torque variations according an embodiment.

FIG. 3 is an exemplary graph 300 of an engine system utilizing active fuel management with reduced amplitude of first order torque variations. Embodiments of engine systems illustrated in the graph are described above in FIGS. 1-2. The graph 300 includes an x-axis illustrating a crank angle 302 (in degrees) for a first cylinder of the engine (e.g., the firing first cylinder of an inline four cylinder engine) that is firing during the fuel saving mode (AFM) and a y-axis illustrating a gauge pressure 304 (in bars). For the exemplary four cylinder engine, a second cylinder that is deactivated will have a crank angle 180 degrees different than the first cylinder. A pressure is plotted for the cylinders that are firing or combusting as well as for the cylinders that are deactivated. In an embodiment, the graph 300 illustrates cylinder pressures for a four cylinder engine in fuel saving mode, where two of the cylinders are deactivated. The graph shows a pressure difference for an engine system with injected air and a system without injected air to reduce amplitude of first order torque variations. A plot 308 represents a cylinder pressure of a first cylinder that is firing during the fuel saving mode. A plot 306 represents a cylinder pressure of a fourth cylinder (where the cylinders are referred to according to placement in the block; e.g., a third cylinder is adjacent to a second and fourth cylinders) that is firing during the fuel saving mode. As depicted, the first cylinder fires close to 0 degrees of crank angle while the fourth cylinder fires close to a crank angle of 360 degrees, where each of the firing angles are offset a selected amount from 360 and zero degrees.

While the engine system is in the fuel saving mode, a plot 310 represents the cylinder pressures in the second and third cylinders without injection of supplemental air into the deactivated cylinders. As depicted, the pressures in the deactivated cylinders have a peak of less than three bars and may actually have a slight negative pressure at certain points during the engine cycle. A plot 312 represents the cylinder pressures of the second and third cylinders with injection of supplemental air, where the cylinder pressures have a peak value of about 21 bars. The peak pressure value for the second and third cylinders provide increased compression pressure in the deactivated cylinders to reduce an amplitude of torque fluctuations in the engine system.

Figure 4:
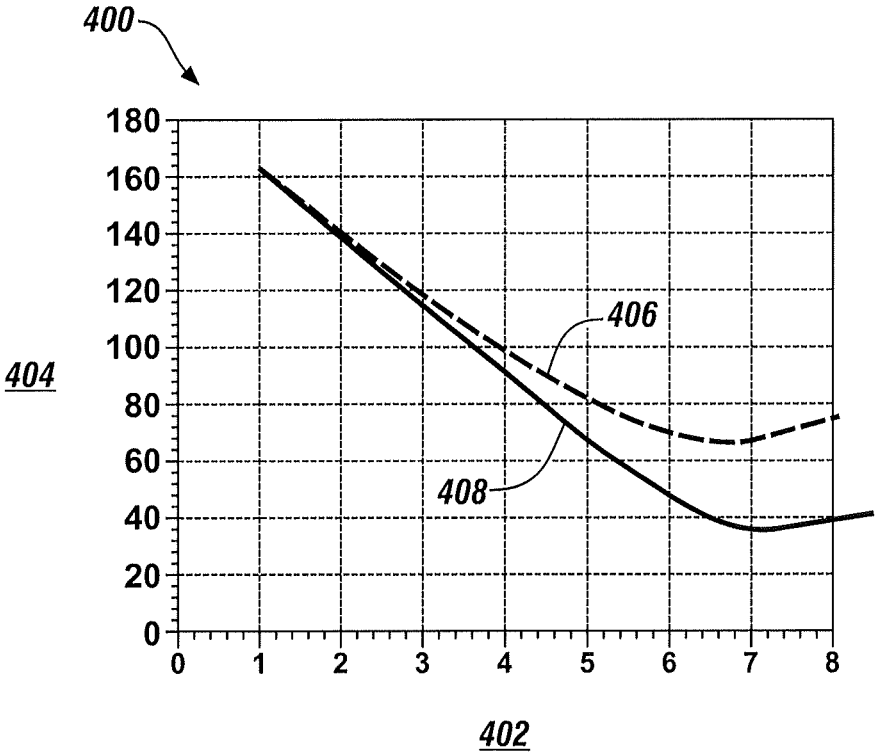
FIG. 4 is a graph of an engine system utilizing active fuel management with reduced amplitude of first order torque variations according an embodiment.

FIG. 4 is an exemplary graph 400 of an engine system utilizing active fuel management with reduced amplitude of first order torque variations. Embodiments of engine systems illustrated in the graph are described above in FIGS. 1-2. The graph 400 includes an x-axis illustrating a pressure multiplier value 402 and a y-axis illustrating an amplitude for first order torque variation 404 (in Newton-meters). First order torque variation amplitude is plotted for the cylinders that are deactivated during a fuel saving mode at several pressure values for the deactivated cylinders, represented by the pressure multiplier 402. Plot 406 represents first order torque variation amplitude for deactivated cylinders when the crank firing angles for the engine are even, such as when the angles between cylinder firings are 180-180-180-180 (for a four cylinder engine). Plot 408 represents first order torque variation amplitude for deactivated cylinders when the crank firing angles for the engine are offset, such as when the angles between cylinder firings are 165-195-165-195 (for a four cylinder engine). Offset crank firing angles are discussed further below with respect to FIG. 5. In an embodiment, the pressure multiplier of one represents the data for first order torque variation amplitude without injection of air into the deactivated cylinders. The plots 406 and 408 both illustrate that the torque amplitude is reduced as the pressure multiplier value increments from one to about six or seven. The pressure multiplier values may be controlled by injected air into the deactivated cylinders at bottom dead center, as described above.

In an embodiment of plot 406, air is injected into the deactivated cylinders the first order torque amplitude by at least 50% at a pressure multiplier of about 6.6 as compared to engine operation at a pressure multiplier of about one (without the air injection). The first order torque amplitude may be reduced from about 165 N-m at pressure multiplier value of one to about 70 N-m at a pressure multiplier value of 6.6. In an embodiment of plot 408, air is injected into the deactivated cylinders the first order torque amplitude by at least 70% at a pressure multiplier of about 6.9 as compared to engine operation at a pressure multiplier of about one (without the air injection). The first order torque amplitude may be reduced from about 165 N-m at pressure multiplier value of one to about 38 N-m at a pressure multiplier value of 6.9. Therefore, injection of supplemental air into the deactivated cylinders provides a reduced amplitude for first order torque variations, where the offset firing angles may provide additional reduction in first order torque variations.

Figure 5:
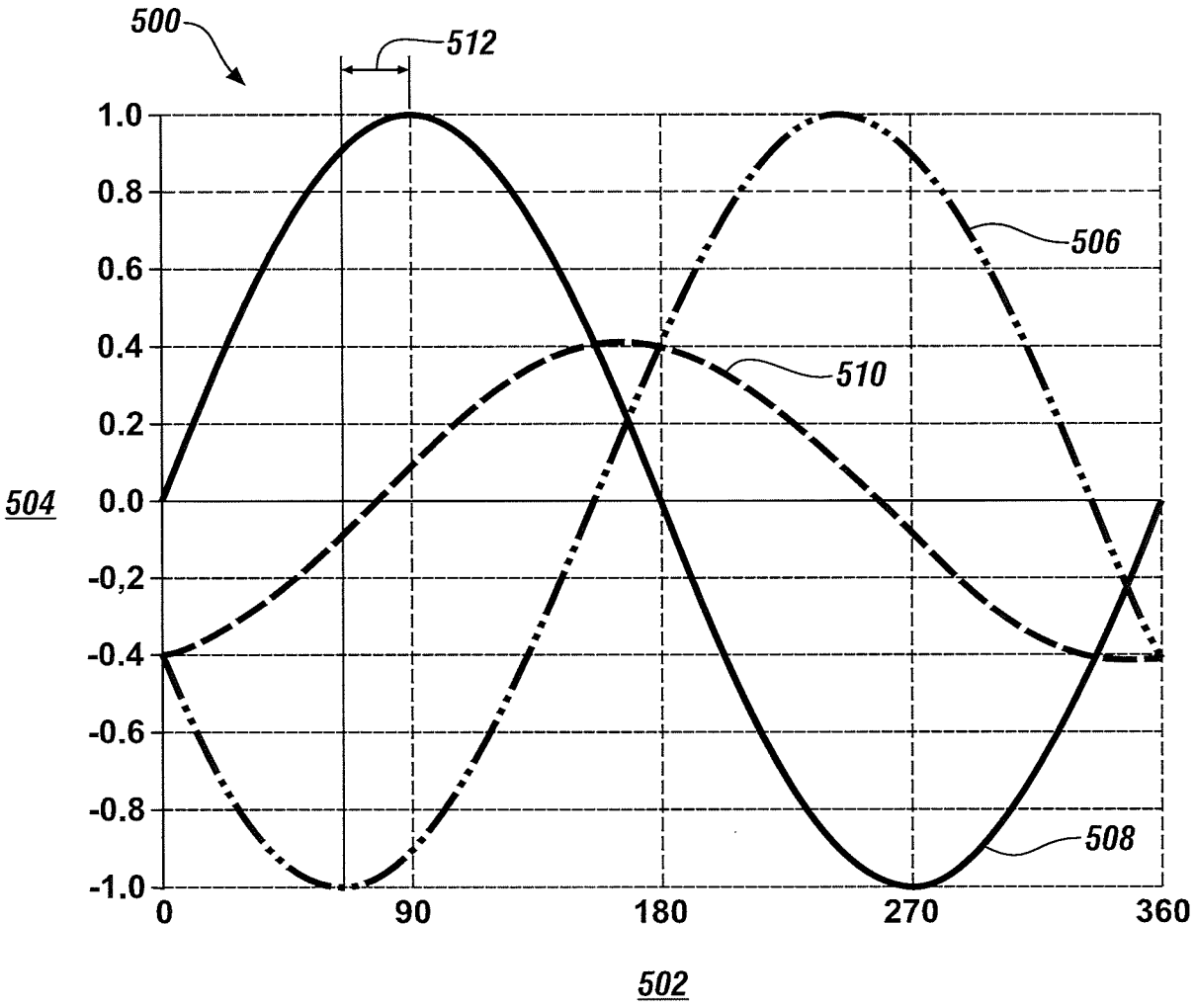
FIG. 5 is a graph of an engine system utilizing active fuel management with reduced amplitude of first order torque variations according an embodiment.

FIG. 5 is an exemplary graph 500 of an engine system utilizing active fuel management with reduced amplitude of first order torque variations. Embodiments of engine systems illustrated in the graph are described above in FIGS. 1-2. The exemplary graph 500 shows a phasing adjustment of harmonics to cancel each other to reduce amplitude of torque variations. The graph 500 illustrates an angle 502 for first order amplitude of torque variation represented by an x-axis and first order torque magnitude 504 represented by a y-axis. A plot 506 illustrates the first order torque magnitude for deactivated cylinders (also referred to as "motoring cylinders") during the engine cycle. A plot 508 illustrates the first order torque magnitude for firing cylinders during the engine cycle.

The pressure injection to reduce torque variation is performed as described above, to increase the amplitude of plot 506 (for deactivated cylinders) is substantially the same as the amplitude of plot 508. Because the first order torque variations of plots 506 and 508 are substantially opposite to allow for some cancellation of the first order torque variations of firing cylinders 508 by first order torque variations for deactivated cylinders 506. A plot 510 illustrates the resultant combined first order torque magnitude for the deactivated and firing cylinders of the engine during the engine cycle. The resultant first order magnitude is caused by, at least in part, and is proportional to a phase difference 512 between the first order torques for the firing and deactivated cylinders. Accordingly, adjusting a crank angle for the engine cylinders may reduce an amplitude of a first order torque variation by reducing the magnitude of resultant plot 510. Adjusting the crank angle will reduce the phase difference 512 to enable increased cancellation of the torque between firing and deactivated cylinders (plots 506, 508) during a fuel saving mode.

In an embodiment, a firing interval of the deactivated cylinders and the firing cylinders are adjusted by altering or adjusting the crank angles to further reduce an amplitude of the first order torque variations during a fuel saving mode. In embodiments, successively firing cylinders have different crank angles on a modified crank shaft. In one embodiment of an inline four cylinder engine, a firing order is 1-3-4-2. For an exemplary inline four cylinder engine, the corresponding firing interval for an adjusted crank is 165-195-165-195 (degrees), wherein successively firing cylinders have different crank angles. Accordingly, the amplitude of the first order torque variations during a fuel saving mode is decreased by reducing the phase difference 512, which is accomplished by manipulating the crank angles to bring motoring torque phases completely out of phase (i.e., 180 degrees offset) to firing torque phases. In embodiments, adjusting the crank angles is beneficial when the engine operates in the fuel saving mode, the adjusted crank angles may introduce first order torque amplitudes during regular engine operation (i.e., with all cylinders firing). Accordingly, the crank angle adjustment and corresponding phase shifting of first order torque magnitude for deactivated cylinders has to be balanced for both operating modes (i.e., fuel saving and regular operation).

Figure 6:
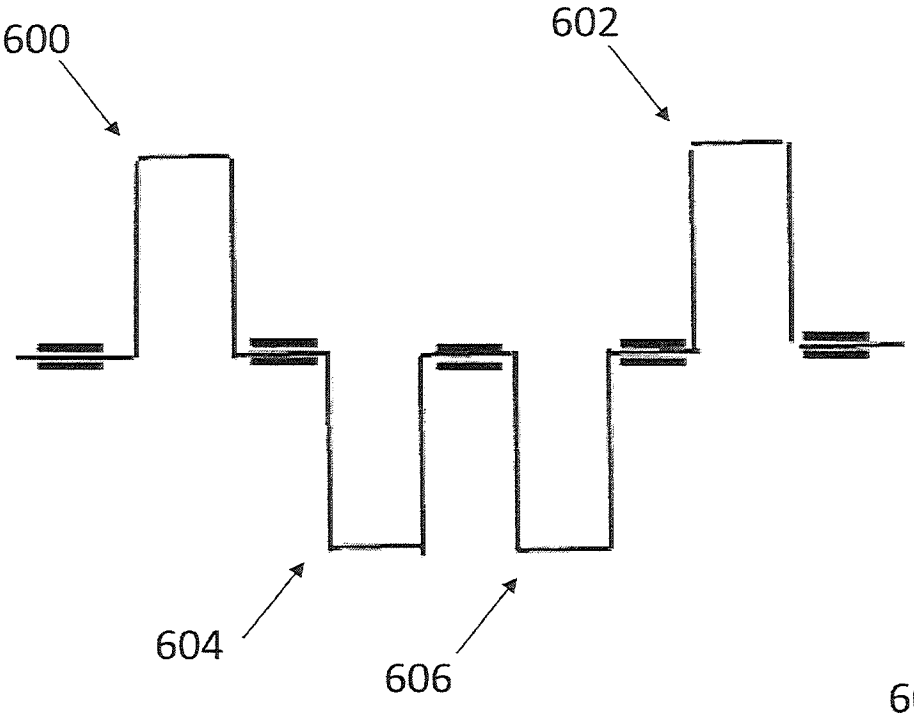
FIGS. 6 and 7 are diagrams of exemplary cranks with modified firing angles to further reduce the amplitude of first order torque variations according an embodiment.
Figure 7:
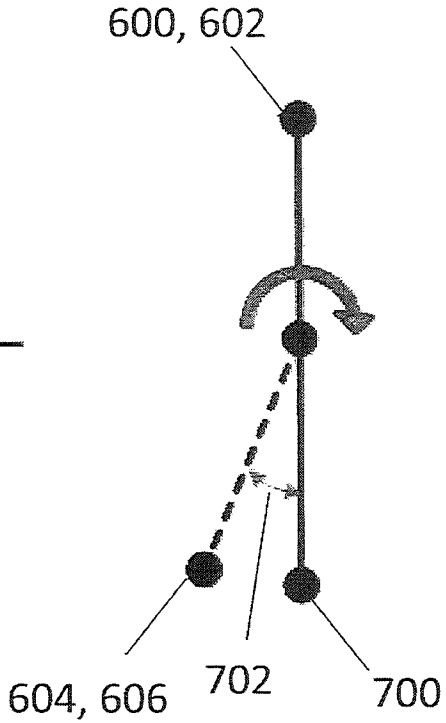

FIGS. 6 and 7 are diagrams of exemplary cranks with modified firing angles to further reduce the amplitude of first order torque variations, as described above with reference to FIG. 5. FIG. 6 is a schematic side view of an exemplary crank for an inline four cylinder engine, where firing angles between the cylinders are depicted. A first cylinder 600 firing angle or location is adjacent to a second cylinder 602 firing angle or location. A third cylinder 604 firing angle is located between a fourth cylinder 606 firing angle and the second cylinder 602 firing angle. FIG. 7 is an end view of the exemplary crank of FIG. 6. Firing location 700 is a position for firing the second and third cylinders before adjusting the firing angle, as described above (e.g., where the firing angles are 180-180-180-180). Angle 702 is the adjustment to the original firing angle provided by the depicted modified crank, where the modified crank has a further reduction to amplitude of the first order torque variation. In embodiments, the angle 702 corresponds to the phase angle 512, where the modified crank enables an increased cancellation between the first order torque variations of firing cylinders 508 an the first order torque variations for deactivated cylinders 506.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A method for active fuel management in an engine having a plurality of cylinders, the method comprising:

stopping a fuel flow into a first set of the plurality of cylinders, the stopping causing a deactivation of the first set of the plurality of cylinders;

continuing injection of fuel into a second set of the plurality of cylinders to provide power while the first set of the plurality of cylinders are deactivated; and injecting gas into the first set of the plurality of cylinders when each of the first set of the plurality of cylinders are at bottom dead center, the injected gas increasing a cylinder pressure in each of the first set of the plurality of cylinders that reduces an amplitude of first order torque variations during operation of the engine while the first set of the plurality of cylinders are deactivated.

2. The method of claim 1, wherein injecting gas into the first set of the plurality of cylinders comprises injecting gas into the first set while air flow and fuel flow valves are closed to stop combustion during a deactivated mode for the first set of the plurality of cylinders.

3. The method of claim 2, wherein injecting gas into the first set of the plurality of cylinders comprises injecting gas via a supplemental line for each of the first set of the plurality of cylinders, where the supplemental lines are located in an engine head.

4. The method of claim 1, wherein injecting gas into the first set of the plurality of cylinders comprises controlling the cylinder pressure based on engine load and engine speed.

5. The method of claim 1, further comprising controlling the cylinder pressure based on a pressure at bottom dead center in supplemental gas supply lines fluidly connected to the first set of the plurality of cylinders.

6. The method of claim 5, wherein injecting gas into the first set of the plurality of cylinders comprises controlling a pressure of an injected gas based on an amount of gas that leaks by piston rings in the first set of the plurality of cylinders, wherein gas injection compensates for leaked gas.

7. The method of claim 1, wherein injecting gas into the first set of the plurality of cylinders comprises reducing the amplitude of first order torque variations by at least 50% during cylinder deactivation as compared to engine operation during cylinder deactivation without gas injection into the first set of the plurality of cylinders.

8. The method of claim 1, further comprising adjusting a firing interval of the first set and second set of the plurality of cylinders to further reduce the amplitude of first order torque variations.

9. The method of claim 8, wherein adjusting the firing interval of the first set and second set of the plurality of cylinders comprises adjusting a crank angle of a crankshaft for each of the plurality of cylinders.

10. An internal combustion engine comprising:

a first set of cylinders;

a second set of cylinders;

a fuel supply line and an air intake for each cylinder of the first and second sets of cylinders;

a supplemental gas supply line for each cylinder of the second set of cylinders; and a controller communicably coupled to the supplemental gas supply line, wherein the controller is configured to perform a method, the method comprising:

stopping a fuel flow into the first set of cylinders, the stopping causing a deactivation of the first set of cylinders;

continuing injection of fuel into the second set of cylinders to provide power while the first set of cylinders are deactivated; and injecting gas, via the supplemental gas supply lines, into the first set of cylinders when each of the first set of cylinders are at bottom dead center, the injected gas increasing a cylinder pressure in each of the first set of the plurality of cylinders that reduces an amplitude of first order torque variations during operation of the engine while the first set of the plurality of cylinders are deactivated.

11. The internal combustion engine of claim 10, wherein injecting gas into the first set of the plurality of cylinders comprises injecting gas into the first set while air flow and fuel flow valves are closed to stop combustion during a deactivated mode for the first set of the plurality of cylinders.

12. The internal combustion engine of claim 11, wherein injecting gas into the first set of the plurality of cylinders comprises injecting air via a supplemental line for each of the first set of the plurality of cylinders, where the supplemental lines are located in an engine head.

13. The internal combustion engine of claim 10, wherein injecting gas into the first set of the plurality of cylinders comprises controlling the cylinder pressure based on engine load and engine speed.

14. The internal combustion engine of claim 10, further comprising controlling a pressure of the injected gas based on a pressure at bottom dead center in the supplemental gas supply lines fluidly connected to the first set of the plurality of cylinders.

15. The internal combustion engine of claim 14, wherein injecting gas into the first set of the plurality of cylinders comprises controlling a pressure of injected gas based on an amount of gas that leaks by piston rings in the first set of the plurality of cylinders, wherein gas injection compensates for leaked gas.

16. The internal combustion engine of claim 10, wherein injecting gas into the first set of the plurality of cylinders comprises reducing the amplitude of first order torque variations by at least 50% during cylinder deactivation as compared to engine operation during cylinder deactivation without gas injection into the first set of the plurality of cylinders.

17. The internal combustion engine of claim 10, further comprising adjusting a firing interval of the first set and second set of the plurality of cylinders to further reduce the amplitude of first order torque variations.

18. The internal combustion engine of claim 17, wherein adjusting the firing interval of the first set and second set of the plurality of cylinders comprises adjusting a crank angle of a crankshaft for each of the plurality of cylinders.

19. A method for active fuel management in an engine having a plurality of cylinders, the method comprising:

stopping a fuel flow into a first set of the plurality of cylinders, the stopping causing a deactivation of the first set of the plurality of cylinders;

continuing injection of fuel into a second set of the plurality of cylinders to provide power while the first set of the plurality of cylinders are deactivated;

injecting air into the first set of the plurality of cylinders to increase a cylinder pressure in each of the first set of the plurality of cylinders to reduce an amplitude of first order vibration during operation of the engine while the first set of the plurality of cylinders are deactivated; and adjusting a firing interval of the first set and second set of the plurality of cylinders to further reduce the amplitude of first order vibrations.

20. The method of claim 19, wherein adjusting the firing interval of the first set and second set of the plurality of cylinders comprises adjusting a crank angle of a crankshaft for each of the plurality of cylinders, wherein successively firing cylinders have different crank angles.

* * * * *